US005115522A

United States Patent [19]

Wright

[11] Patent Number: 5,115,522

[45] Date of Patent: May 26, 1992

[54] CONCEALMENT TROLLEY

[76] Inventor: Howard S. Wright, 436 Devon Street West, New Plymouth, New Zealand

[21] Appl. No.: 519,391

[22] Filed: May 4, 1990

[30] Foreign Application Priority Data

May 5, 1989 [NZ] New Zealand ..... 229017

[51] Int. Cl.[5] ..... A61G 7/08

[52] U.S. Cl. ..... 5/81.1; 5/86.1; 414/917; 414/495; 414/337; 27/28

[58] Field of Search ..... 27/28; 414/495, 917, 414/498, 589, 590, 522, 501, 537; 5/81 R, 81 B, 86; 187/9 R

[56] References Cited

U.S. PATENT DOCUMENTS

| | | | |
|---|---|---|---|
| 2,654,897 | 10/1953 | Knopf | 5/86 |
| 3,034,843 | 5/1962 | Moon | 27/28 X |
| 3,126,112 | 3/1964 | Shaw et al. | 414/495 |
| 4,104,748 | 8/1978 | Brisco | 5/81 B X |
| 4,259,756 | 4/1981 | Pace | 5/86 X |
| 4,839,933 | 6/1989 | Plewright et al. | 5/81 B X |

FOREIGN PATENT DOCUMENTS

| | | | |
|---|---|---|---|
| 0209802 | 1/1987 | European Pat. Off. | 5/81 R |
| 2457635 | 6/1976 | Fed. Rep. of Germany | 5/81 R |

*Primary Examiner*—Frank E. Werner

*Attorney, Agent, or Firm*—Oblon, Spivak, McClelland, Maier & Neustadt

[57] ABSTRACT

A concealment trolley for the transportation of deceased persons which includes a bogie supporting an enclosure. The enclosure preferably has an overall outward appearance resembling a piece of mobile hospital equipment. In the enclosure there is a mechanism whereby a deceased person can be loaded on a litter or platform into the enclosure and fully concealed therewithin. A support mechanism is located within the enclosure and is adapted to support a litter or platform. The support mechanism is movable so as to be able to raise and lower the litter or platform relative to the enclosure.

15 Claims, 5 Drawing Sheets

CONCEALMENT TROLLEY

BACKGROUND OF THE INVENTION

1. Field of the Invention

This invention relates to a concealment trolley.

2. Discussion of the Background

It has, until recently, been common practice for hospitals to restrict visiting of their patients to certain prescribed hours. Nowadays a more open door policy prevails and visitors can be present in hospital rooms, wards or corridors throughout a major part of the day but more especially during afternoons and evenings.

This presents a problem when it is necessary to move a deceased person within the hospital such as from a room, ward or the like to the mortuary. Human sensitivity requires that the remains be transported discretely. This has, for example, often meant that the room or bed occupied by the deceased is screened off until, late at night after visitors have departed. Then the night staff is able to transport the remains with the minimum of attention. This is not a suitable situation for busy hospitals where rooms and beds are urgently required. Accordingly it is increasingly necessary to deal with the removal of a deceased person to the mortuary as soon as possible.

SUMMARY OF THE INVENTION

The primary object of this invention is thus to provide a concealment trolley which can be used to transport deceased persons concealed within a conveyance which gives no clue to its purpose.

Presently it is known to convey deceased persons by using a conventional hospital transport trolley with a curved sheet metal cover over the platform surface. While such a concealment trolley is capable of transporting a deceased's remains and of concealing them from general view, it does not adequately disguise the trolley's purpose.

As stated, the primary object of this invention is to completely conceal the content of the trolley while giving an outward appearance which belies the fact that it is a means of transporting a deceased person. However, a secondary object of the invention is to provide a concealment trolley which serves to reduce the nurse's effort required to transfer a body from a bed or other support surface to the trolley and/or the physical effort required in the mortuary to transfer the body onto a mortuary table or cold storage cabinet.

Broadly the invention consists of a concealment trolley comprising a bogie supporting an enclosure which has an overall outward appearance resembling a piece of mobile hospital equipment, said enclosure having means whereby a deceased person can be loaded into and fully concealed within the enclosure.

In its preferred form the concealment trolley includes movable support means within the enclosure, the support means being adapted to support a litter or platform. The movable support means can be raised and lowered so as to locate the litter or platform at a position which assists in the loading and unloading of a body to and from the enclosure.

According to one form of the invention the enclosure has a plurality of openings which are concealed by removable covers. The movable support means is such that it can be raised to be located adjacent one such opening to permit the loading onto the litter of a body and then lowered to locate the litter and body within the enclosure. To unload the body, the litter can be removed via one of the openings after removal of the cover therefrom.

Preferably there is provided an arrangement which in use can form a bridge between an opening in the enclosure and a surface on which a deceased person is located to assist in transfer of the deceased person onto the litter. This bridge arrangement can be carried by and be external of the housing and preferably has the outward appearance of safety sides normally associated with hospital trolleys, beds and like equipment.

BRIEF DESCRIPTION OF THE DRAWINGS

In the following more detailed description of the invention according to a preferred form, reference will be made to the accompanying drawings in which.

DESCRIPTION OF THE PREFERRED EMBODIMENTS

Figure 1:
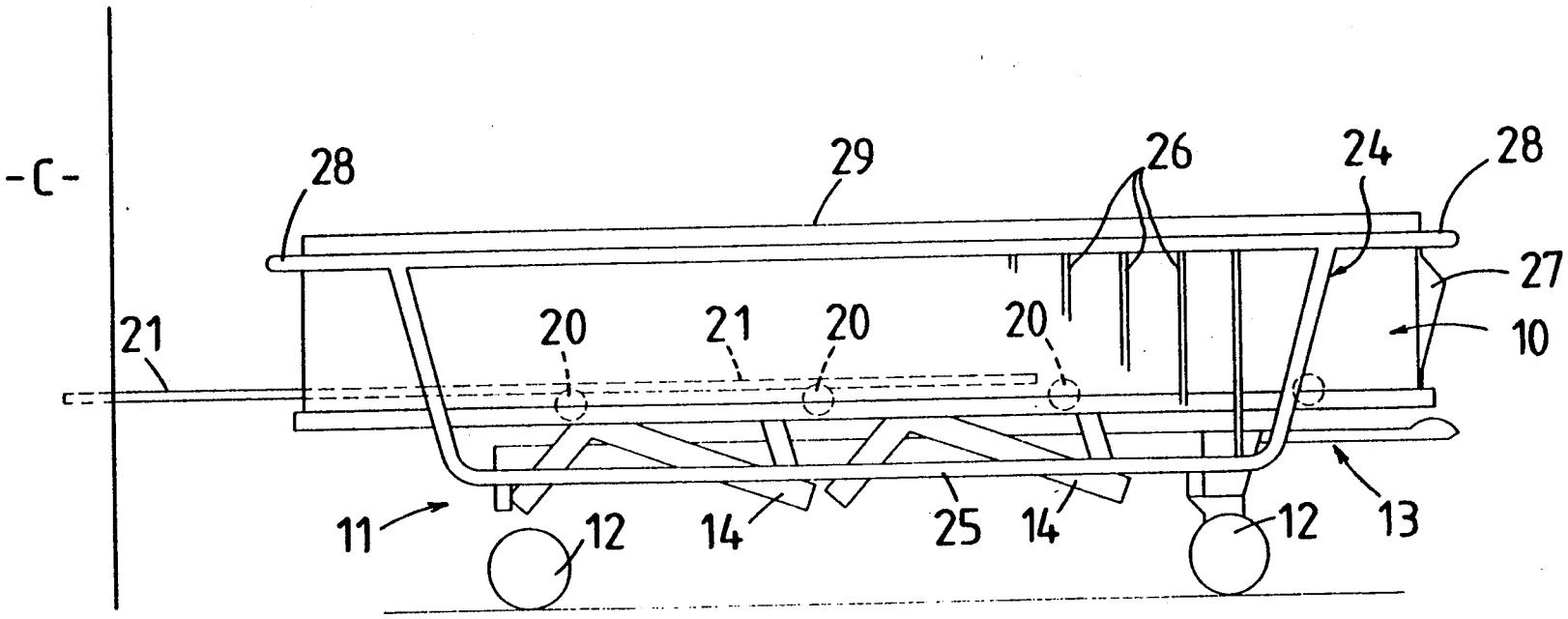
FIG. 1 is an elevational view of the concealment trolley showing the litter or platform partially extended from the enclosure with one end thereof represented as entering a cold storage chamber in a mortuary.

Essentially the enclosure 10 of the concealment trolley comprises a rectangular box or housing with no fixed top or bottom. This enclosure 10 is mounted on a wheeled frame or bogie 11 equipped with large lockable castors 12 and a mechanical means 13 of raising and lowering enclosure 10. In the illustrated arrangement hydraulic power is utilised to activate two elevating arms 14 which function as a parallelogram to raise and lower the enclosure. Such equipment is in common usage in hospital equipment and is well known to those skilled in the art. A further description therof is not necessary for the purposes of understanding the present invention.

Located at the bottom of the enclosure are a plurality (e.g. four) of arms 15 extending from axles 16 and all connected together by a common shaft 17 which is moved back and forth by hydraulic ram 18 activated by a hydraulic pump separate to that so, mechanical means 13. As a consequence of the back and forth movement of the common shaft 17 the four arms 15 can pivot from a substantially horizontal position (see FIG. 1) to a substantially vertical position (see FIG. 2) within enclosure 10.

Pivoted arms 15 terminate at their free ends in an axle 19 that has a flanged roller 20 at each end. These rollers 20 are located close to the sides of the enclosure 10.

Figure 4:
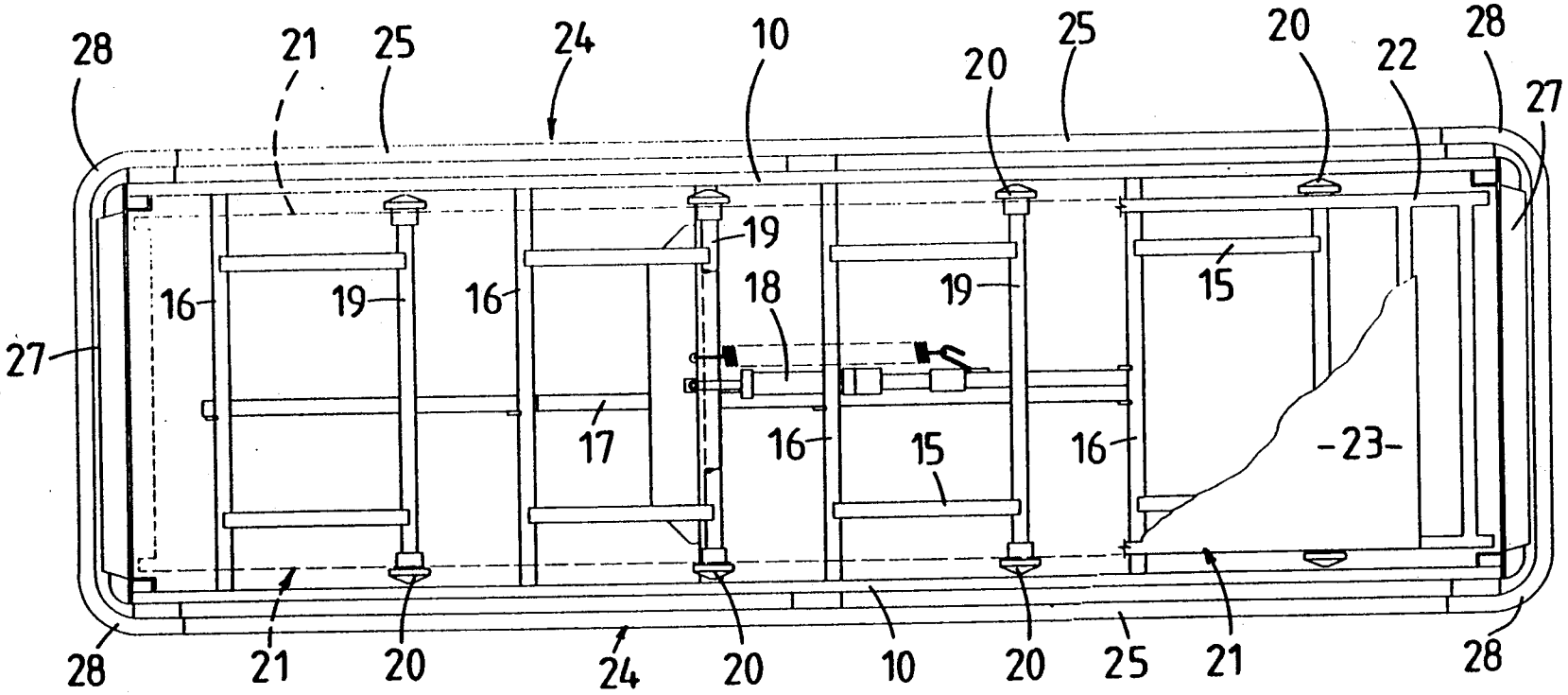
FIG. 4 is a plan view of the concealment trolley but with the litter only partially shown.

A transferable litter or platform 21 is supported by rollers 20 so that litter 21 can be slid through opening 30 at one end of the enclosure 30. This litter 21 in the preferred form comprises a tubular steel frame work 22 (see FIGS. 4 and 5) supporting a plastic or metal tray 23. The litter assembly 21 is dimensioned to support a human body and to correspond with the sizes acceptable by mortuary cabinets.

The litter 21 and enclosure 10 are so dimensioned in length, breadth and depth, that a large human form can be supported on the litter and fully enclosed within the rectangular enclosure when the pivoted arms 15 are in their lowered or substantially horizontal position at the bottom of the enclosure. When the four arms 15 are raised from the horizontal to vertical position by actuation of the second hydraulic system, the litter 21 and its load can be raised to a level at or preferably slightly above (see FIG. 2) the open top of enclosure 10.

As enclosure 10 is substantially of rectangular form, appendages are provided so as to distract from the box like appearance and therefore convey to the casual observe not a rectangular box but rather a specialised piece of mobile hospital equipment.

Supported on each side of enclosure 10 are side rails 24 which are comprised of a tubular frame work 25 with closely spaced vertical bars 26. The side rails 24 are preferably brightly polished so as to arrest the eye and give the appearance of the safety sides normally associated with hospital trolleys. The square ends 30 of the enclosure can have attached to them shaped plastic mouldings or panels 27 which present to the eye various angled surfaces. Push rails 28, also preferably brightly polished, are located at each end 30 of the enclosure and continue around the sides thereof to link up with the side rails 24 to provide an all enclosing buffer rail.

Figure 5:
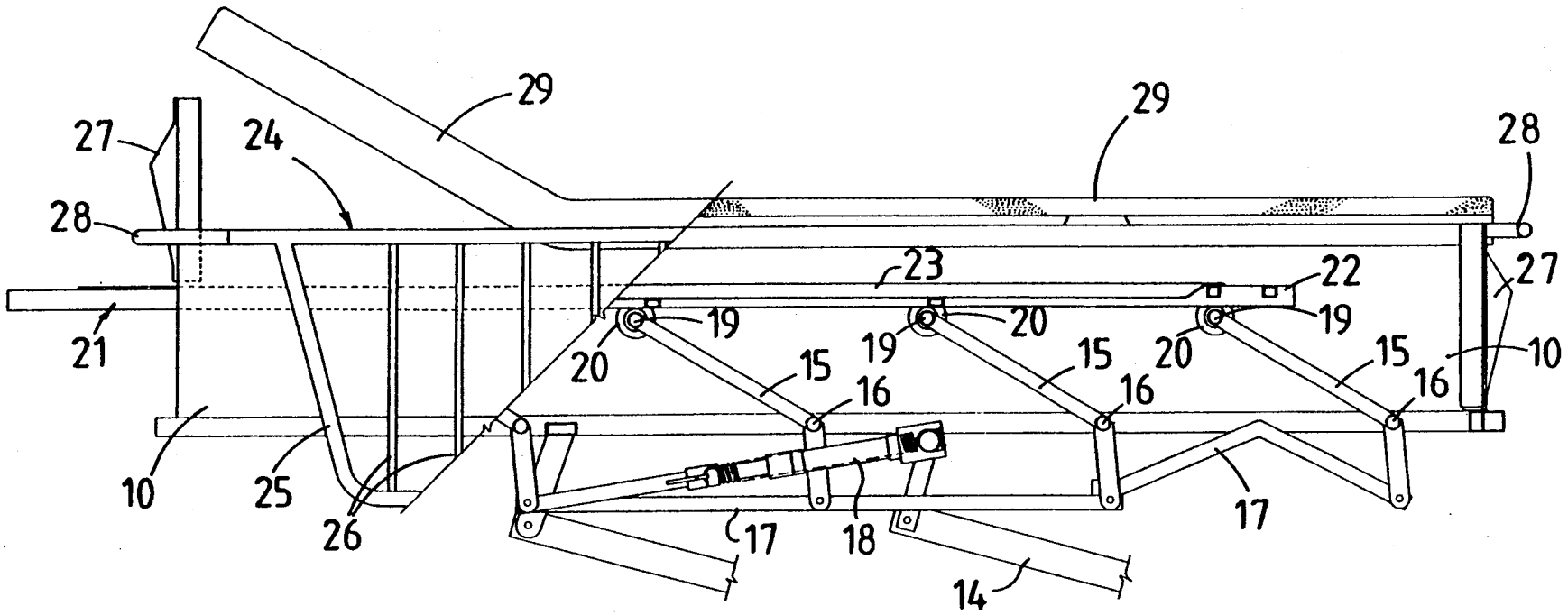
FIG. 5 is a partially sectioned elevation view showing the enclosure and the litter support arrangement.

The top of the enclosure is covered by a pseudo mattress 29. This has only minimal padding sufficient to support a cover which gives the illusion of a mattress. It has a spanning support which allows the mattress covering to be readily removed. Preferably, as indicated in FIG. 5, the cover/mattress is articulated so that it can be folded back upon itself to be compact and hence easily removable.

The structure of the enclosure 10 and enclosed movable litter support mechanism is mounted on a bogie that is conventional for mobile hospital equipment.

The main purpose of the concealment trolley according to the present invention is to conceal deceased persons remains during the journey from a part of a hospital to its mortuary and to conceal them in such a way that the casual observer see an apparently unoccupied trolley or specialist piece of hospital equipment.

However, the concealment trolley according to the present invention has such a construction that it reduces the physical effort required by nurses or mortuary staff in transferring the body to and from the trolley to a degree that transfers can be achieved by one person working alone.

The transfer procedure is as follows:

1. The concealment trolley is located near one side of the deceased's bed. The false mattress 29 is then removed and the litter 21 raised to its upper position (see FIG. 2). The near side side rail 24 is raised to the vertical position.

2. The deceased's body is then turned on its side away from the trolley and the trolley is moved to be closely adjacent the side of the bed whereupon the side rail 24 is lowered so as to rest on the bed and form a connecting bridge or platform.

Figure 2:
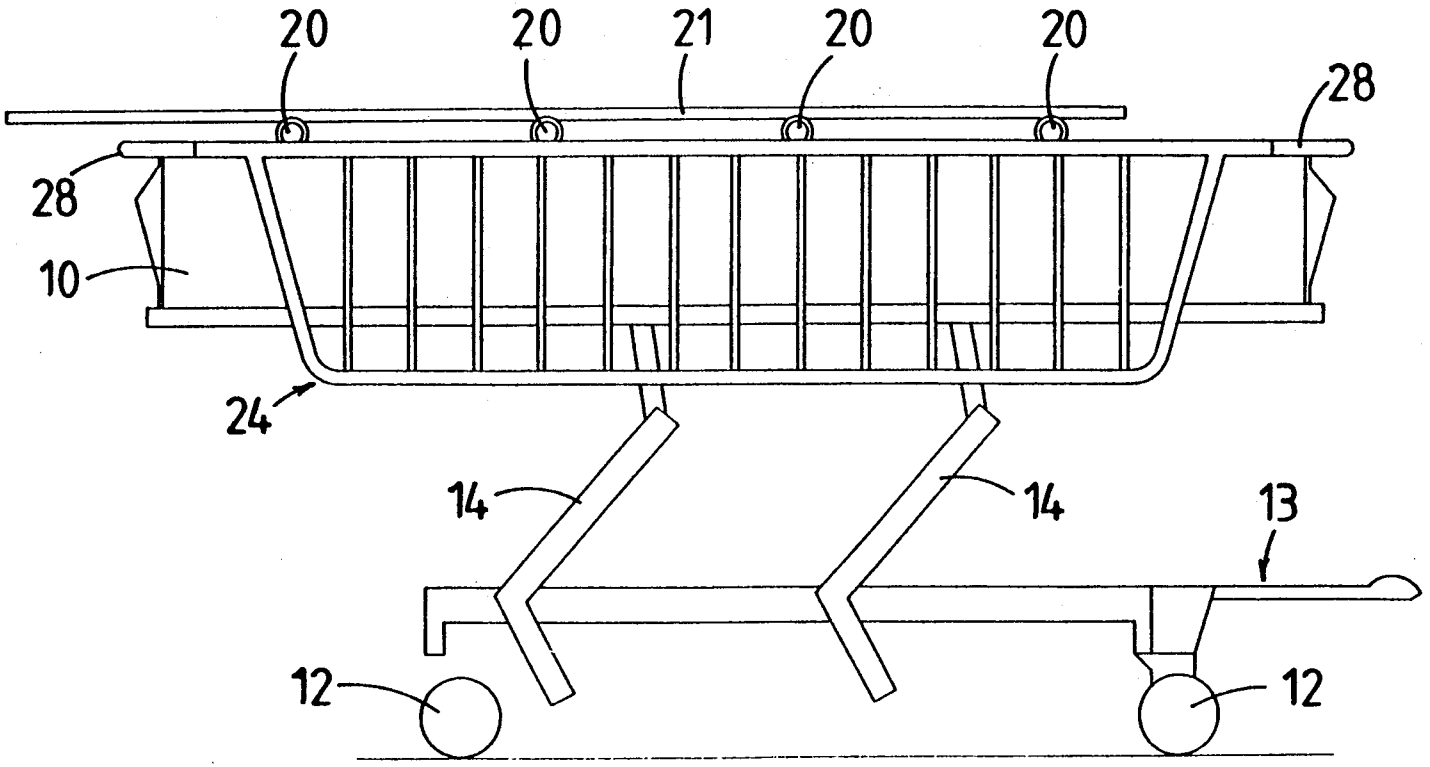
FIG. 2 is an elevational view of the concealment trolley with the litter in the elevated position and partially removed from the litter support arrangement.
Figure 3:
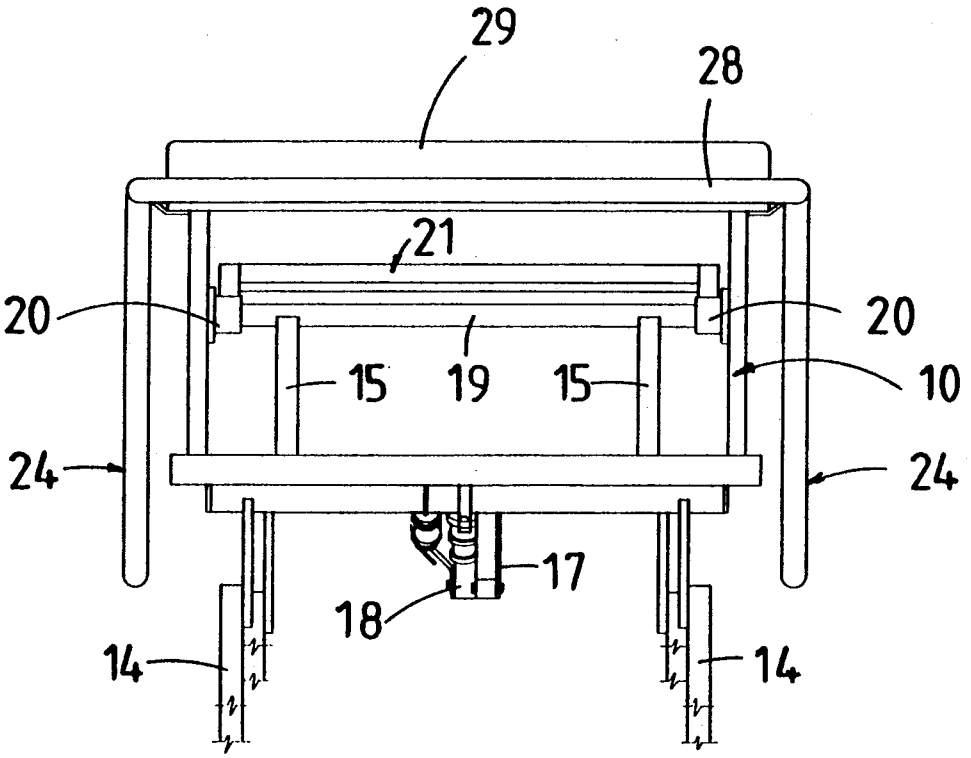
FIG. 3 is an end view of the arrangement illustrated in FIG. 1 but with the litter partially raised within the enclosure.

3. A transfer sheet is then placed on the side rail 24 and the body turned from the side to the back so that it lies substantially on the transfer sheet and side rail. The transfer sheet and hence the body is then drawn across the side rail 24 until it rests on the litter 21 and the litter is then lowered so that the body is located within the confines of the enclosure (i.e. as shown in FIG. 1).

4. The trolley is then withdrawn from the bedside and the side rail lowered. The covering mattress is replaced.

In the mortuary the concealment trolley height can be adjusted to that of the mortuary table and the inner platform or litter raised clear of the top periphery of the enclosure. The body can then be transferred to the mortuary table by either using substantially a reverse of the procedure described above or by the litter being moved on the rollers to effect transfer.

Similarly the trolley can be height adjusted to correspond with the predetermined levels for storage in mortuary cabinets C. For transfer into low level storage cabinets C, each end of the concealment trolley is movable so that by sliding upwardly the appropriate end (see FIGS. 1 and 5) the litter 21 and body can be removed therethrough.

Obviously, numerous modifications and variations of the present invention are possible in light of the above teachings. It is therefore to be understood that within the scope of the appended claims, the invention may be practiced otherwise than as specifically described herein.

What is claimed is:

1. A concealment trolley, which comprises:

a wheeled frame;

an enclosure into which a deceased person is loadable and fully concealed;

first raising and lowering means mounted on said wheeled frame and coupled with said enclosure such that the enclosure can be raised and lowered relative to said wheeled frame, said enclosure having an open top and a removable cover for closing of said open top, said enclosure also having an opening located at least at one end therof and closure means for closing said opening;

second raising and lowering means operable to raise and lower a removable platform means relative to said enclosure, said second raising and lowering means including transport means such that said platform means can be moved onto or from said second raising and lowering means via said opening when said closure means is in an open position;

said second raising and lowering means locating, when in a raised position, said platform means at or adjacent said open top such that with the cover removed the deceased person can be loaded onto said platform means.

2. A concealment trolley as claimed in claim 1 wherein said second raising and lowering means includes a plurality of support elements which are movable within said enclosure, and said transport means includes a plurality of roller means carried by said support elements and on which said platform means is located so as to be slidingly movable relative to said enclosure.

3. A concealment trolley as claimed in claim 2 wherein the support elements are pivotally mounted within the enclosure and comprise operating means such that the support elements can be simultaneously moved about their respective pivot axis.

4. A concealment trolley as claimed in claim 3, wherein the operating means comprises a linear actuator operatively coupled to a shaft, said shaft being connected with an axle of each said support element such that as the linear actuator is operated the shaft causes the axles to rotate and establish the simultaneous pivotal movement of the support elements.

5. A concealment trolley as claimed in claim 1 wherein the cover is adapted to support a mattress.

6. A concealment trolley as claimed in claim 1 wherein the cover comprises a simulated mattress.

7. A concealment trolley as claimed in claim 1 wherein said second raising and lowering means is operable to raise said platform means located on said transport means through and clear of said open top when said cover has been removed.

8. A concealment trolley as claimed in claim 7 wherein a bridge element is shaped like a safety side normally associated with hospital trolleys.

9. A concealment trolley as claimed in claim 7 wherein the removable cover comprises a simulate mattress and is of an articulated construction so as to be foldable back upon itself.

10. A concealment trolley as claimed in claim 1 wherein one of said first and second raising and lowering means comprises a plurality of support elements which are located within said enclosure and are pivotally movable between raised and lowered positions, and operating means coupled to said support elements such that the support elements can be simultaneously moved about a respective pivot axis.

11. A concealment trolley as claimed in claim 10 wherein said transport means comprises a plurality of roller means carried by said support elements and on which said platform means is slidingly movable relative to said enclosure.

12. A concealment trolley as claimed in claim 11 wherein the operating means comprises a shaft and a linear actuator operably connected to said shaft, said shaft being connected with an axle of each said support element, each said axle of said support elements extending between side walls of the enclosure.

13. A concealment trolley, which comprises:

a wheeled frame;

an enclosure into which a deceased person is loadable and fully concealed;

first raising and lowering means mounted by said wheeled frame and coupled with said enclosure such that the enclosure can be raised and lowered relative to said wheeled frame, said enclosure having an open top and a removable cover for closing said removable cover, said enclosure also having an opening located at least at one end thereof and said opening being closed by closure means;

second raising and lowering means operable to raise and lower removable platform means relative to said enclosure, said second raising and lowering means including transport means such that said platform means can be moved onto or from said second raising and lowering means via said opening when said closure means is in an open position;

said second raising and lowering means locating, when in a raised position, said platform means at or adjacent said open top such that with the cover removed the deceased person is loadable onto said platform means; and at least one bridge structure mounted externally of the enclosure and pivotally coupled to the enclosure adjacent the open top, said bridge structure being movable from a rest position wherein said bridge structure hangs downwardly to an in use position where said bridge structure extends outwardly from the enclosure so as to be locatable with a surface on which said deceased person is located.

14. A concealment trolley as claimed in claim 13 wherein the bridge element is shaped like a safety side of a hospital trolley.

15. A concealment trolley as claimed in claim 13 wherein said closure means comprises a panel which forms an end of said enclosure, said panel being slidably removable to open said end.

* * * * *